United States Patent [19]

Saigal

[11] 4,378,554

[45] Mar. 29, 1983

[54] FIXED/MOVABLE SUPERVISED ALARM LOOP

[75] Inventor: Anil Saigal, Mt. Prospect, Ill.

[73] Assignee: Honeywell Inc., Minneapolis, Minn.

[21] Appl. No.: 227,024

[22] Filed: Jan. 19, 1981

[51] Int. Cl.[3] ..... G08B 29/00

[52] U.S. Cl. ..... 340/506; 340/508; 340/531; 340/825.05

[58] Field of Search ..... 340/500, 506, 531, 533, 340/541, 545, 825.05, 825.06, 825.11, 825.12, 508–511

[56] References Cited

U.S. PATENT DOCUMENTS

| | | | |
|---|---|---|---|
| 2,944,252 | 7/1960 | Muehter | 340/276 |
| 3,029,420 | 4/1962 | Bagno et al. | 340/213 |
| 3,351,934 | 11/1967 | Vietz | 340/409 |
| 3,611,362 | 10/1971 | Scott | 340/409 |
| 3,815,112 | 6/1974 | Kleber | 340/533 |
| 3,978,466 | 8/1976 | Simon | 340/533 |

*Primary Examiner*—John W. Caldwell, Sr.
*Assistant Examiner*—Donnie L. Crosland
*Attorney, Agent, or Firm*—Trevor B. Joike

[57] ABSTRACT

An alarm sensing loop for selectively monitoring at least first and second alarm sensors includes terminals for connection to a source, a selection circuit connected to the terminals and having first and second states, a first alarm sensor connected to the selection circuit to be supervised continuously when the selection circuit is in its first and second states, a second alarm sensor, and a selection state sensing circuit for allowing supervision of the second alarm sensor when the selection circuit is in its first state and for preventing supervision of the second alarm sensor when the selection circuit is in its second state.

18 Claims, 2 Drawing Figures

FIXED/MOVABLE SUPERVISED ALARM LOOP

BACKGROUND OF THE INVENTION

The present invention relates to an alarm sensing arrangement and, more particularly, to an alarm sensing loop in which some of the alarm sensors (fixed) are continuously surpervised and others of the alarm sensors (movable) may be selectively supervised.

The monitoring of alarm sensors in buildings can be accomplished either by a central station which is located remotely from the building or an alarm panel which is located locally within the building. The typical central station is connected to many buildings throughout a town or city and monitors either the current levels on direct wired systems in which a pair of wires is specifically dedicated to connecting the central station to a single customer's premises or the codes which identify which customer of a plurality of customers connected by a pair of wires to the central station is providing an alarm. The operator of the central station then watches the current levels or codes and will contact local police or security forces in the event of alarm conditions. The local panel, however, provides local alarm indications at the customer's premises and may or may not be tied into police stations.

All of the systems discussed above typically utilize alarm loops located within the customer's premises. Such alarm loops usually comprise a plurality of alarm sensors which may, for example, include switches for sensing the opening of doors and windows, and/or strip sensors which are, in effect, normally closed switches for sensing the breakage or cutting of the glass of windows or doors. Some of these sensors must be supervised continuously regardless of the time of day whereas others of the sensors should not be supervised during certain times of the day. For example, door switches are supervised only during hours of non-occupancy such that, if the building is not occupied, an opening of the supervised door switch will result in an alarm but an opening of the door during hours of occupancy will not result in an alarm. Other switches such as the sensing strips on windows should be supervised continuously so that a breakage thereof during hours of either occupancy or non-occupancy will result in an alarm.

SUMMARY OF THE INVENTION

The present invention provides a simple arrangement for segregating the continuously supervised alarm sensors from the selectively supervised alarm sensors. This arrangement includes terminals for connection to a source, a selection apparatus connected to the terminals and having first and second states, at least a first alarm sensor connected to the selection apparatus to be energized by the source continuously when the selection apparatus is in the first and second states, at least a second alarm sensor, and a selection state sensing circuit for energizing the second alarm sensor when the selection apparatus is in the first state and for deenergizing the second alarm sensor when the selection means is in the second state.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
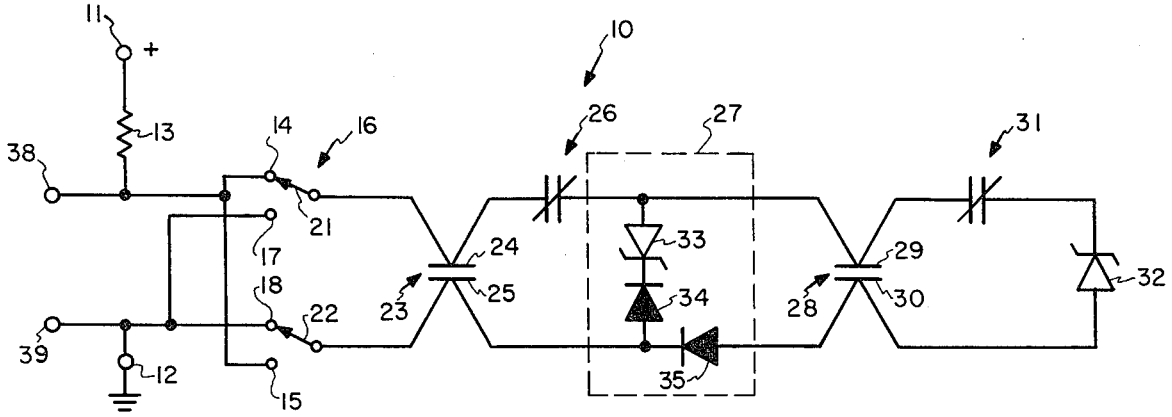
FIG. 1 shows the alarm loop according to the present invention in which all alarm sensors are supervised; and, FIG. 2 shows the alarm loop according to the present invention in which certain alarm sensors have been deenergized.
Figure 2:
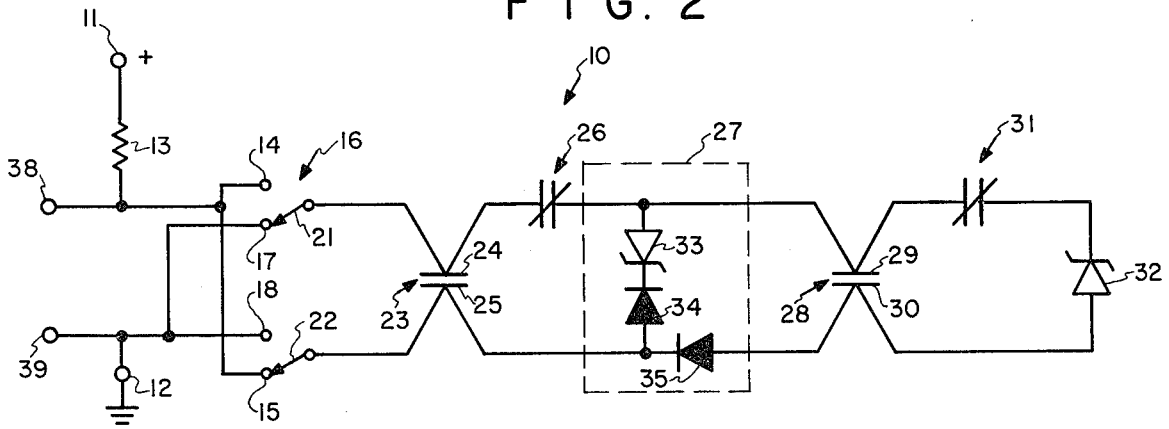

In FIGS. 1 and 2, alarm loop 10 has terminal 11 for connection to a source of voltage and terminal 12 connected to a reference such as ground. Terminal 11 is connected through resistance 13 to stationary contacts 14 and 15 of double pole, double throw switch or selection element 16. Switch 16 could be a solid state device. Terminal 12 is connected to stationary contacts 17 and 18 of switch 16. Movable contact 21 of switch 16 selects between stationary contacts 14 and 17 and movable contact 22 of switch 16 selects between stationary contacts 15 and 18.

Movable contact 21 is connected to contact 24 of parallel alarm sensor 23. Contact 24 of sensor 23 is connected through series alarm sensor 26 and through fixed/movable or selection station sensing element 27 to contact 29 of parallel alarm sensor 28. Contact 29 of parallel alarm sensor 28 is connected through series alarm sensor 31 and end-of-line element 32 to contact 30 of sensor 28. Contact 30 of sensor 28 is connected through diode 35 of element 27 to contact 25 of sensor 23 which contact is connected to movable contact 22 of switch 16.

Element 27 is comprised of zener diode 33 and diode 34 connected in series between contact 25 of sensor 23 and contact 29 of sensor 28. Diode 35 is connected from contact 30 of switch 28 to the junction of contact 25 of alarm sensor 23 and diode 34. Element 27 is responsive to the position of switch 16 for energizing or deenergizing alarm sensors 28 and 31. Alarm sensors 28 and 31 may be, for example, door switches which are normally used, i.e. opened and closed, during hours of occupancy. However, during hours of non-occupancy, any opening or closing of switches 28 and 31 should provide an alarm indication. On the other hand, alarm sensors 23 and 26 may be, for example, window strip sensors and/or switches which remain unused during periods of both occupancy and non-occupancy. Thus, these alarm sensors are continuously supervised such that if one of them is operated, an alarm indication is given. Because sensors 23 and 26 are continuously supervised, they may be referred to as fixed sensors, and because sensors 28 and 31 are selectively supervised, they may be referred to as movable sensors. Fixed/movable element 27, being positioned between the fixed and movable sensors allows the fixed sensors to be continuously supervised and the movable sensors to be selectively supervised.

Switch or selection element 16 has two positions or states. The first state is shown in FIG. 1 with movable contact 21 contacting stationary contact 14 and movable contact 22 contacting stationary contact 18. In this configuration, current flows from source 11 and through resistor 13, stationary contact 14, movable contact 21, contact 24 of alarm sensor 23, alarm sensor 26, contact 29 of alarm sensor 28, alarm sensor 31, end-of-line element 32, diode 35 of element 27, contact 25 of alarm sensor 23, movable contact 22, stationary contact 18, terminal 12, and through return to the other side of the source. Diode 34 prevents shorting of sensors 28 and 31. End-of-line element 32 establishes a predetermined loop current level which can be monitored then for alarm conditions. For example, if one of the parallel alarm sensors 23 or 28 should close, end-of-line element 32 is shorted and the current in the loop increases. However, if one of the series alarm sensor 26 or 31 should open, the loop is opened and the current falls which can be sensed to provide an alarm indication. This configuration is useful, for example, in monitoring all alarm sensors within a building during hours of non-occupancy.

However, during hours of occupancy, alarm sensors 28 and 31, for example, may be deenergized. Thus, according to the diagram shown in FIG. 2, switch 16 is operated to its lower position such that movable contact 21 contacts stationary contact 17 and movable contact 22 contacts stationary contact 15. Thus, the selection switch 16 is in its second state and the second state is sensed by element 27 for deenergizing alarm sensors 28 and 31. In this condition, current flows from source terminal 11 and through resistance 13, stationary contact 15, movable contact 22, contact 25 of alarm sensor 23, diode 34 of element 27, zener diode 33 acting as an end-of-line element to the reverse current flow, alarm sensor 26, contact 24 of alarm sensor 23, movable contact 21, stationary contact 17, terminal 12 and through ground back to the source. Thus, diode 35 blocks any current flow to alarm sensors 28 and 31. In this condition, any operation of alarm sensors 28 and 31 has no effect on the monitoring circuit connected to loop 10. However, alarm sensors 23 and 26 are still supervised such that closure of 23 shorts end-of-line element 33 to provide an increased current level which can be sensed by the monitoring circuit connected to loop 10 and the opening of alarm sensor 26 lowers the current in the loop which again can be sensed by the monitoring circuit connected to loop 10.

Terminals 38 and 39 are provided in loop 10 so that a monitoring circuit can be connected to loop 10 for monitoring the current levels in the loop to provide alarm indications should the current level exceed a predetermined threshold indicating that alarm sensor 23 or alarm sensor 28 has been closed or falls below a given threshold indicating that alarm sensor 26 or alarm sensor 31 has been opened. Such a monitoring circuit can include Schmitt triggers, for example, operating off of two reference levels such that a current changing above a first threshold in a first direction will trigger one Schmitt trigger whereas the current changing below a second threshold in a second direction will trigger another Schmitt trigger.

The embodiments of the invention in which an exclusive property or right is claimed are defined as follows:

1. An alarm sensing loop for selectively supervising at least first and second alarm sensors comprising:

terminal means for connection to a source;

selection means connected to said terminal means and having first and second states;

first alarm sensing means connected to said selection means to be continuously supervised when said selection means is in said first and second states;

second alarm sensing means; and, selection state sensing means connected to said second alarm sensing means and responsive to said selection means such that said second alarm sensing means is supervised when said selection means is in said first state and is not supervised when said selection means is in said second state.

2. The loop of claim 1 wherein said selection means comprises a switch.

3. The loop of claim 2 wherein said switch comprises a mechanical switch having first and second positions.

4. The loop of claim 3 wherein said first alarm sensing means comprises at least a first normally open alarm sensor and a first normally closed alarm sensor.

5. The loop of claim 4 wherein said second alarm sensing means comprises at least a second normally open alarm sensor and a second normally closed alarm sensor.

6. The loop of claim 5 wherein said mechanical switch comprises a double pole, double throw switch having first and second stationary contacts connected to one terminal of said terminal means and third and fourth stationary contacts connected to a second terminal of said terminal means, and first and second movable contacts.

7. The loop of claim 6 wherein said first and second normally open and normally closed contacts and said selection state sensing means are connected with an end-of-line element in a loop configuration such that when said switch is in said first position said first movable contact contacts said first stationary contact and said second movable contact contacts said fourth stationary contact said first and second normally open and normally closed alarm sensors are supervised and when said switch is in said second position said first movable contact contacts said third stationary contact and said second movable contact contacts said second stationary contact only said first normally open and said first normally closed alarm sensors are supervised.

8. The loop of claim 7 wherein said selection state sensing means comprises first and second diodes connected between said first and second alarm sensing means for allowing current flow through said first and second normally closed sensors when said mechanical switch is in said first position and for shunting said second alarm sensing means when said mechanical switch is in said second position, and an end-of-line element connected in series with said second diode to act as an end-of-line element only when said mechanical switch is in said second position.

9. The loop of claim 1 wherein said selection state sensing means comprises first and second diodes connected between said first and second alarm sensing means for allowing supervision of both said first and second alarm sensing means when said selection means is in said first state and for shunting said second alarm sensing means when said selection means is in said second state, and an end-of-line element connected in series with said second diode to act as an end-of-line element only when said selection means is in said second state.

10. An alarm sensing loop for selectively monitoring at least first and second alarm sensors comprising:

terminal means for connection to a source;

selection means connected to said terminal means and having a first state for allowing current flow in a first direction through said loop and a second state for allowing current flow in a second direction through said loop;

first alarm sensing means connected to said selection means to be continuously supervised when said selection means is in said first and second states;

second alarm sensing means; and, current direction sensing means connected to said second alarm sensing means for permitting supervision of said second alarm sensing means when said current flow is in said first direction and responsive to said selection means for preventing supervision of said second alarm sensing means when said current flow is in said second direction.

11. The loop of claim 10 wherein said selection means comprises a switch.

12. The loop of claim 11 wherein said switch comprises a mechanical switch having first and second positions.

13. The loop of claim 12 wherein said first alarm sensing means comprises at least a first normally open alarm sensor and a first normally closed alarm sensor.

14. The loop of claim 13 wherein said second alarm sensing means comprises at least a second normally open alarm sensor and a second normally closed alarm sensor.

15. The loop of claim 14 wherein said mechanical switch comprises a double pole, double throw switch having first and second stationary contacts connected to one terminal of said terminal means and third and fourth stationary contacts connected to a second terminal of said terminal means, and first and second movable contacts.

16. The loop of claim 15 wherein said first and second normally open and normally closed contacts and said selection state sensing means are connected with an end-of-line element in a loop configuration such that when said mechanical switch is in said first position said first movable contact contacts said first stationary contact and said second movable contact contacts said fourth stationary contact said first and second normally open and normally closed alarm sensors are supervised and when said mechanical switch is in said second position said first movable contact contacts said third stationary contact and said second movable contact contacts said second stationary contact only said first normally open and said first normally closed alarm sensors are supervised.

17. The loop of claim 16 wherein said current direction sensing means comprises first and second diodes connected between said first and second alarm sensing means for allowing current flow through said first and second alarm sensing means in said first direction when said mechanical switch is in said first position and for allowing current flow through only said first alarm sensing means in said second direction when said mechanical switch is in said second position, and an end-of-line element connected in series with said second diode to act as an end-of-line element only when said mechanical switch is in said second position.

18. The loop of claim 10 wherein said current direction sensing means comprises first and second diodes connected between said first and second alarm sensing means for allowing current flow through said first and second alarm sensing means in said first direction when said selection means is in said first state and for allowing current flow through only said first alarm sensing means in said second direction when said selection means is in said second state, and an end-of-line element connected in series with said second diode to act as an end-of-line element only when said selection means is in said second state.

* * * * *